US011051667B1

(12) United States Patent
Chan

(10) Patent No.: US 11,051,667 B1
(45) Date of Patent: Jul. 6, 2021

(54) CLEANING APPARATUS FOR CLEANING SURFACES

(71) Applicant: Erik Chan, Orinda, CA (US)

(72) Inventor: Erik Chan, Orinda, CA (US)

( * ) Notice: Subject to any disclaimer, the term of this patent is extended or adjusted under 35 U.S.C. 154(b) by 0 days.

(21) Appl. No.: 17/137,341

(22) Filed: Dec. 29, 2020

(51) Int. Cl.
*A47K 11/10* (2006.01)
*A46B 5/00* (2006.01)
*A46B 9/00* (2006.01)

(52) U.S. Cl.
CPC ..... *A47K 11/10* (2013.01); *A46B 5/0095* (2013.01); *A46B 9/005* (2013.01); *A46B 2200/304* (2013.01)

(58) Field of Classification Search
CPC ... A47K 11/10; A46B 2200/304; A46B 17/04; A46B 5/0095; A47L 13/17; E03C 1/308
USPC ..... 15/104.93–104.94, 247; 4/255.11
See application file for complete search history.

(56) References Cited

U.S. PATENT DOCUMENTS

| | | | | |
|---|---|---|---|---|
| 3,383,158 A | | 5/1968 | Leland | |
| 4,075,033 A | * | 2/1978 | Knox | A47K 7/08 134/6 |
| 4,384,382 A | * | 5/1983 | Diamant | A46B 9/005 15/104.001 |
| 5,709,006 A | * | 1/1998 | Carter, Jr. | A47L 13/44 15/143.1 |
| 7,127,768 B2 | * | 10/2006 | Blum | A47K 11/10 15/104.94 |
| 7,861,858 B2 | | 1/2011 | Wang | |
| 9,970,186 B2 | * | 5/2018 | Hodkiewicz | E03C 1/308 |
| 10,413,139 B2 | * | 9/2019 | Singer | A47K 17/00 |
| 2015/0320269 A1 | | 11/2015 | Ward, Jr. | |

FOREIGN PATENT DOCUMENTS

| | | | | |
|---|---|---|---|---|
| EP | 1247482 | | 11/2002 | |
| EP | 1938729 | | 1/2017 | |
| GB | 2338888 A | * | 1/2000 | A47K 11/10 |
| GB | 2371474 A | * | 7/2002 | A47K 11/10 |

* cited by examiner

*Primary Examiner* — Laura C Guidotti
(74) *Attorney, Agent, or Firm* — Kanika Radhakrishnan; Evergreen Valley Law Group

(57) ABSTRACT

Embodiments of the present disclosure provide a cleaning apparatus for cleaning surfaces. The cleaning apparatus includes a cleaning brush. The cleaning brush includes a handle, a stem and a cleaning head. The stem includes a first end and a second end. The handle is coupled to the first end of the stem and extends longitudinally from the stem. The handle is adapted to be held by a user. The cleaning apparatus further includes an elongated tubular sheath secured with a cleaning pad. The elongated tubular sheath includes a closed end and an open end. The open end is configured to allow receipt of the cleaning brush within the elongated tubular sheath. The cleaning pad includes an inner space. The cleaning pad is secured to the closed end of the elongated tubular sheath. The cleaning head is accommodated in the inner space by pushing the closed end within the cleaning pad.

17 Claims, 4 Drawing Sheets

CLEANING APPARATUS FOR CLEANING SURFACES

TECHNICAL FIELD

The present disclosure relates to a cleaning apparatus for cleaning surfaces and, more particularly relates, to the cleaning apparatus including a cleaning brush with a disposable bag secured with a removable absorbent cleaning pad for cleaning toilet bowls.

BACKGROUND

Bathroom and toilet are amongst the frequently visited areas in any residency and fixtures therein are used frequently by the users. As the toilets are used frequently in a day, it is necessary to maintain the toilets clean and hygienic to prevent harmful bacterial growth, unpleasant odor and unsanitary conditions. Cleaning a toilet bowl is one of the most undesirable household chores for most of the people, as the toilets are contaminated by various organic materials that support growth of microorganisms. In addition, the contamination of the toilet bowl can lead to health hazards for the people.

The toilets are most commonly cleaned with conventional cleaning implements such as brushes or a wet mopping implement. The conventional toilet brushes may include bristles that are permanently affixed to a handle or an absorbent synthetic sponge which wipes the surfaces to be cleaned. Thus, during a cleaning or wiping act, the brush or the wet mop is used to repeatedly wipe the target surface. However, the conventional brushes and mops face serious drawbacks related to storage between their usages. This is because, small quantities of bacteria, feces particles and unsanitary liquids collect on the bristles and the mop, thus leaving the cleaning implement in an unsanitary condition after use. Typically, it is preferable not to store such implements in proximity to the toilet or next to clean objects or in closed spaces that do not allow for drying of the cleaning implement. Further, rinsing of the brushes and the mop for reusing it requires several rinsing flushes (e.g., more than once or twice). Rinsing of the cleaning implement for reusing it is a time-consuming process and results in wastage of water to thoroughly clean the cleaning implement after every usage.

Therefore, there is a need for techniques to overcome one or more limitations stated above in addition to providing other technical advantages.

SUMMARY

Various embodiments of the present disclosure provide a cleaning apparatus for cleaning surfaces.

In an embodiment, a cleaning apparatus for cleaning a target surface is disclosed. The cleaning apparatus includes a cleaning brush. The cleaning brush includes a stem including a first end and a second end. A handle is coupled to the first end of the stem and extends longitudinally from the stem. The handle is adapted to be held by a user. A cleaning head is coupled to the second end of the stem. The cleaning apparatus further includes an elongated tubular sheath including an open end and a closed end. The open end is configured to allow receipt of the cleaning brush within the elongated tubular sheath. Further, the cleaning apparatus includes a cleaning pad. The cleaning pad includes an inner space. The cleaning pad is secured to the closed end of the elongated tubular sheath. Upon receipt of the cleaning brush within the elongated tubular sheath from a side of cleaning head, the cleaning head is accommodated in the inner space by pushing the closed end within the cleaning pad.

In another embodiment, a cleaning apparatus for cleaning a target surface is disclosed. The cleaning apparatus includes a cleaning brush. The cleaning brush includes a stem including a first end and a second end. A handle is coupled to the first end of the stem and extends longitudinally from the stem. The handle is adapted to be held by a user. A cleaning head is coupled to the second end of the stem. The cleaning apparatus further includes an elongated tubular sheath including an open end and a closed end. The open end is configured to allow receipt of the cleaning brush within the elongated tubular sheath. Further, the cleaning apparatus includes a cleaning pad. The cleaning pad includes an inner space. The cleaning pad is secured to the closed end of the elongated tubular sheath. Upon receipt of the cleaning brush within the elongated tubular sheath from a side of cleaning head, the cleaning head is accommodated in the inner space by pushing the closed end within the cleaning pad. The cleaning brush inserted within the elongated tubular sheath causes an interior surface of the elongated tubular sheath to contact an exterior surface of the cleaning head, while accommodating the cleaning head in the inner space of the cleaning pad.

BRIEF DESCRIPTION OF THE FIGURES

The following detailed description of illustrative embodiments is better understood when read in conjunction with the appended drawings. For the purpose of illustrating the present disclosure, exemplary constructions of the disclosure are shown in the drawings. However, the present disclosure is not limited to a specific device or a tool and instrumentalities disclosed herein. Moreover, those in the art will understand that the drawings are not to scale. Wherever possible, like elements have been indicated by identical numbers.

Figure 1:
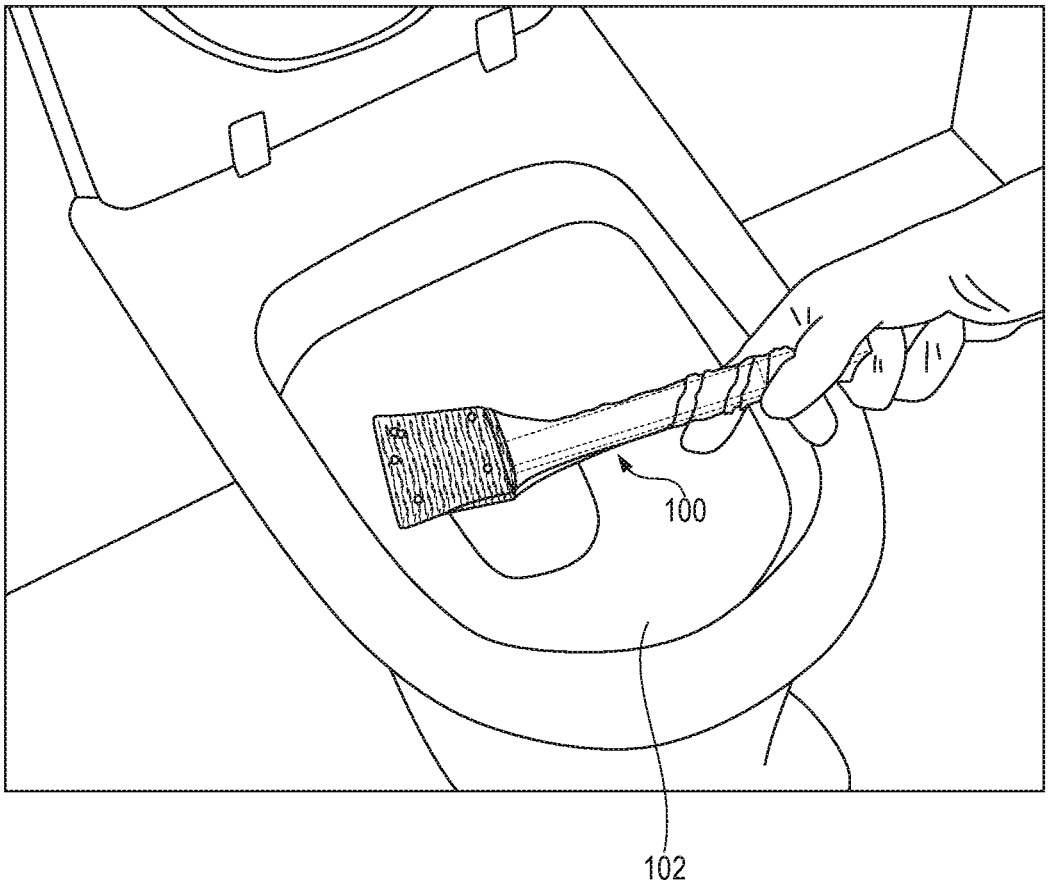
FIG. 1 illustrates a schematic view of a cleaning apparatus for cleaning a target surface, in accordance with an example embodiment of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearances of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

The terms "wiping" or "cleaning" refers to any shearing action that a cleaning pad or a substrate undergoes while in contact with a target surface. This includes hand or body motion, substrate-implement motion over a surface.

Overview

Various embodiments of the present disclosure provide a cleaning apparatus for cleaning a target surface (e.g., toilet bowls). In an embodiment, the cleaning apparatus includes a cleaning brush. The cleaning brush includes a handle, a stem and a cleaning head. The stem includes a first end and a second end. The handle is coupled to the first end of the stem and extends longitudinally from the stem. The handle is adapted to be held by a user. The cleaning head is coupled to the second end of the stem. The cleaning head may be made of an elastic or compressible material. The cleaning head is configured to conform to contour of the target surface during a cleaning or wiping operation. The cleaning head secured to the second end of the stem may be configured to be rotatably adjustable relative to the stem and the handle of the cleaning brush.

The cleaning apparatus further includes an elongated tubular sheath secured with a cleaning pad. The elongated tubular sheath includes a closed end and an open end. The elongated tubular sheath may be made of elastic or compressible materials. The open end of the elongated tubular sheath is configured with a greater cross-sectional area than the closed end of the elongated tubular sheath. The open end of the elongated tubular sheath is configured to allow receipt of the cleaning brush within the elongated tubular sheath. The cleaning pad includes an inner space and is secured to the closed end of the elongated tubular sheath. The cleaning pad is configured to clean the target surface. Upon receipt of the cleaning brush within the elongated tubular sheath from the side of cleaning head, the cleaning head is accommodated in the inner space by pushing the closed end within the cleaning pad. Further, the cleaning brush inserted within the elongated tubular sheath ensures that an interior surface of the elongated tubular sheath contacts an exterior surface of the cleaning head, while accommodating the cleaning head in the inner space of the cleaning pad. The elongated tubular sheath and the cleaning pad removably secured to the cleaning brush encase the stem, the handle and the cleaning head. Thus, the elongated tubular sheath and the cleaning pad shield the stem, the handle and the cleaning head of the cleaning brush from contacting the target surface while in use. In addition, the cleaning pad is impregnated with cleaning agents to effectuate cleaning of the target surface. The cleaning agents effervesce when the cleaning pad is hydrated during cleaning of the target surface. In an embodiment, the elongated tubular sheath may include a securing member configured proximate to the open end of the elongated tubular sheath. The securing member is removably engaged with an engagement member of the handle upon removably securing the elongated tubular sheath and the cleaning pad to the cleaning brush.

Upon the cleaning or wiping task, the elongated tubular sheath is unsecured and pulled towards the closed end of the elongated tubular sheath by the user such that the elongated tubular sheath is configured to be turned inside-out for enclosing the soiled cleaning pad. Thereafter, the soiled cleaning pad enclosed within the elongated tubular sheath is detached from the cleaning head of the cleaning brush for disposal.

Various embodiments of a cleaning apparatus for cleaning surfaces are described with reference to FIG. 1 to FIGS. 5A-5B.

FIG. 1 illustrates a schematic view of a cleaning apparatus 100 while in use on a target surface, in accordance with an example embodiment of the present disclosure. The cleaning apparatus 100 is used by a user for cleaning a target surface 102 (exemplary depicted to be a 'toilet bowl'). The cleaning apparatus 100 may be used to clean or wipe target surfaces such as, but not limited to, bathrooms, showers, bathtubs and the like. The cleaning apparatus 100 includes a cleaning brush (see, 200 of FIG. 2) and an elongated tubular sheath (see, 302 of FIG. 3) coupled with a cleaning pad (see, 304 of FIG. 3). In the use condition of the cleaning apparatus 100, the elongated tubular sheath 302 secured with the cleaning pad 304 encases the cleaning brush 200. In use condition, the cleaning pad 304 is interposed between the cleaning brush 200 and the target surface 102 (i.e., toilet bowl surface) to be cleaned. Upon completion of a cleaning or wiping task, the elongated tubular sheath 302 secured with the cleaning pad 304 is detached from the cleaning brush 200 for disposal. This configuration of the cleaning apparatus 100 mitigates the storage issue associated with the cleaning brush 200 after each usage, or cleaning or wiping task.

Figure 2:
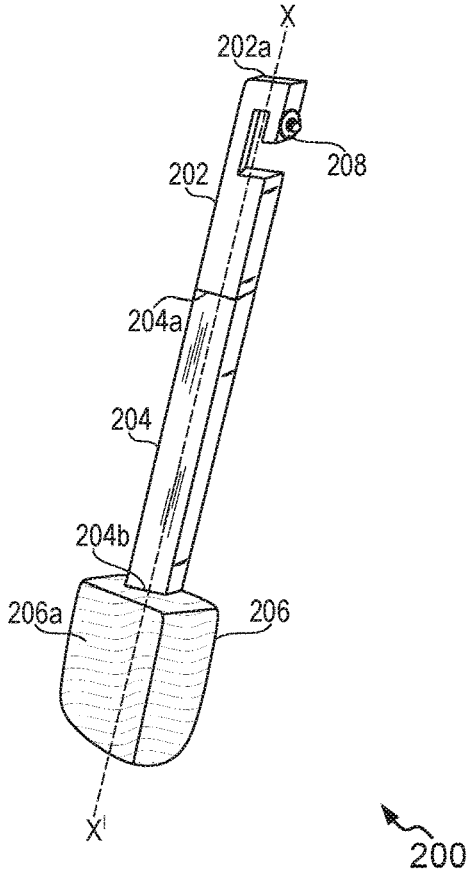
FIG. 2 illustrates a schematic view of a cleaning brush, in accordance with an example embodiment of the present disclosure.

FIG. 2 illustrates a schematic view of the cleaning brush 200, in accordance with an example embodiment of the present disclosure. The cleaning brush 200 includes a handle 202, a stem 204 and a cleaning head 206. The stem 204 includes a first end 204*a* and a second end 204*b*. The handle 202 is coupled to the first end 204*a* of the stem 204 and extends longitudinally from the stem 204. In other words, the handle 202 extends from the first end 204*a* of the stem 204 along a longitudinal axis X-X'. The handle 202 is adapted to be held by the user during the use of the cleaning apparatus 100. The handle 202 may be configured with indentations (not shown in FIGS.) for enhancing grip of the handle 202 to the user during use. In one configuration, the handle 202 and the stem 204 may be a hollow structure and configured with a tapered profile extending from the second end 204*b* of the stem 204 to a proximal end 202*a* of the handle 202. Alternatively, the handle 202 and the stem 204 may be configured with a uniform cross-section along their length. The handle 202 and the stem 204 may be made of materials such as, but not limited to, wood, metal, synthetic material (e.g., plastic) or any other materials as per the design feasibility and requirement. Further, the handle 202 and the stem 204 may be coated with a synthetic film or wax to allow the cleaning brush 200 for protection when exposed to water or cleaning agents, while cleaning the target surface 102 (e.g., toilet, bathtubs). In an embodiment, the stem 204 of the cleaning brush 200 may be configured with an adjustable mechanism (not shown in FIGS.) for adjusting a length dimension of the stem 204. An example of the adjustable mechanism can be a telescopic configuration. In such scenarios, the user may operate the adjustable mechanism for suitably adjusting the length of the stem 204 based on the target surface 102 and operating environment.

The cleaning head 206 is secured to the second end 204*b* of the stem 204 via suitable mounting means. This configuration of the cleaning brush 200 including the handle 202, the stem 204 and the cleaning head 206 affixed to each other conforms to a unibody construction. Alternatively, the cleaning head 206 may be removably mounted to the stem 204. In an embodiment, the cleaning head 206 mounted to the stem 204 may be configured to be rotatably adjustable relative to the stem 204 and the handle 202 of the cleaning brush 200. The cleaning head 206 may be made of materials such as but not limited to, a rubber, an elastic foam or a sponge (e.g., polyurethane foam), or any other elastic or compressible materials as per the design feasibility and requirement. Thus, the cleaning head 206 is configured to mold itself to contour of the target surface 102 (e.g., contour of toilet bowls) or any other surface during the cleaning task. In other words, the cleaning head 206 is configured to conform to the cleaning surfaces (i.e., the target surface 102) during the cleaning task. Further, an exterior surface 206*a* of the cleaning head 206 may be configured to be abrasive. This configuration of the cleaning head 206 enables a friction fit for the cleaning pad (see, 304 of FIG. 3) which is further explained in detail.

Figure 3:
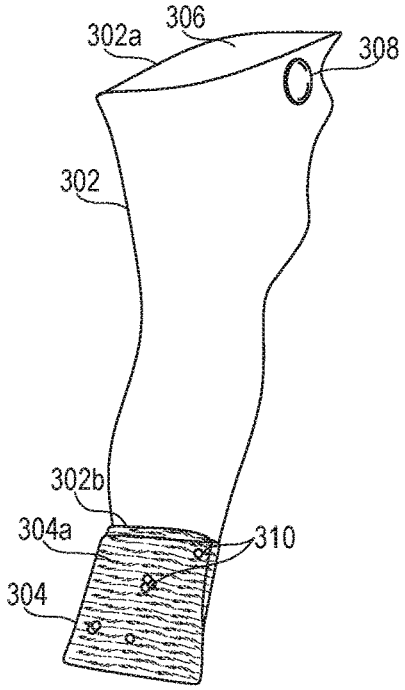
FIG. 3 illustrates a schematic view of an elongated tubular sheath secured with a cleaning pad, in accordance with an example embodiment of the present disclosure.

FIG. 3 illustrates a schematic view of the elongated tubular sheath 302 secured with the cleaning pad 304, in accordance with an example embodiment of the present disclosure. The elongated tubular sheath 302 includes an open end 302*a* and a closed end 302*b*. The open end 302*a* allows the cleaning brush 200 to be inserted within the elongated tubular sheath 302. The elongated tubular sheath 302 may be made of disposable and elastic materials such as, but not limited to, synthetic such as plastic, vinyl and rubber. The open end 302*a* of the elongated tubular sheath 302 may be configured with larger diameter or width than that of the closed end 302*b* of the elongated tubular sheath 302. In other words, the open end 302*a* of the elongated tubular sheath 302 is configured with a greater cross-sectional area than that of the closed end 302*b* of the elongated tubular sheath 302. Thus, the elongated tubular sheath 302 may conform to a tapered profile due to the larger area of cross-section at the open end 302*a* than that of closed end 302*b*. In an embodiment, the elongated tubular sheath 302 may be configured with a uniform profile i.e. the area of cross-section at the open end 302*a* and the closed end 302*b* is equal. The larger area of cross-section at the open end 302*a* enables the cleaning brush 200 to be feasibly inserted within the elongated tubular sheath 302.

The cleaning pad 304 is secured to the closed end 302*b* of the elongated tubular sheath 302 via suitable securing means such as sewing, adhesives, Velcro™ and the like. In an embodiment, the cleaning pad 304 is a pouch like configuration having an inner space, and fabricated to ergonomically fit over the cleaning head 206 of the cleaning brush 200. In other words, the cleaning pad 304 may be configured with elastic and disposable materials with optimum thickness so as to snuggly fit over the cleaning head 206, while the cleaning brush 200 is inserted within the elongated tubular sheath 302. Examples of the materials used for fabricating the cleaning pad 304 are foams, sponges, hydro entangled materials, polyester materials and the like. The cleaning pad 304 may be fabricated with a single layer or multiple layers of material. The cleaning pad 304 may be configured with sufficient wet strength or large void space, abrasivity and porosity.

Figure 4A:
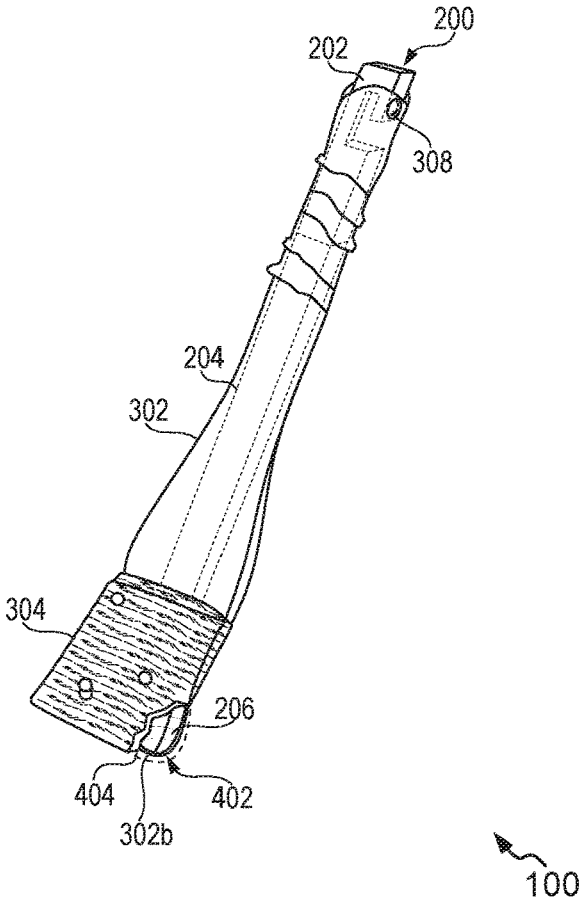
FIGS. 4A and 4B illustrate schematic views of the elongated tubular sheath and the cleaning pad removably secured to the cleaning brush, in accordance with an example embodiment of the present disclosure.

Referring to FIG. 4A in conjunction with FIGS. 2 and 3, the elongated tubular sheath 302 and the cleaning pad 304 are removably secured to the cleaning brush 200. More specifically, the elongated tubular sheath 302 secured with the cleaning pad 304 is pulled over the cleaning head 206, the stem 204 and the handle 202 of the cleaning brush 200. Upon receipt of the cleaning brush 200 within the elongated tubular sheath 302 from the side of cleaning head 206, the cleaning head 206 is accommodated in an inner space (see, 402 of FIG. 4A) of the cleaning pad 304 by pushing the closed end 302*b* within the cleaning pad 304. For the purpose of illustration, the cleaning pad 304 is shown as cut at one corner in FIG. 4A for visualization of the inner space 402 of the cleaning pad 304, the closed end 302*b* and the cleaning head 206. Further, the cleaning brush 200 inserted within the elongated tubular sheath 302 ensures that an interior surface 306 of the elongated tubular sheath 302 contacts an exterior surface 206*a* of the cleaning head 206, while accommodating the cleaning head 206 in the inner space 402 of the cleaning pad 304. The cleaning pad 304 is removably secured over the cleaning head 206 via the friction fit means. Alternatively, the cleaning pad 304 may be removably secured over the cleaning head 206 by adhesives, Velcro™ or any other suitable means as per the design feasibility and requirements. The elongated tubular sheath 302 and the cleaning pad 304 removably secured to the cleaning brush 200 encase the stem 204, the handle 202 and the cleaning head 206 of the cleaning brush 200. For illustration purpose, the handle 202 and the stem 204 of the cleaning brush 200 encased within the elongated tubular sheath 302 is depicted in dashed lines.

Referring back to FIG. 3, the open end 302*a* of the elongated tubular sheath 302 may be configured with a securing member 308 (exemplary depicted to be 'a socket of a snap button'). The securing member 308 is configured to removably engage with an engagement member (see, 208 of FIG. 2) configured proximate to the proximal end 202*a* of the handle 202. Further, a portion of the elongated tubular sheath 302 may be twisted around at least the stem 204 and the handle 202 of the cleaning brush 200, prior to engaging the securing member 308 (e.g., as shown in FIG. 4A). As such, twisting the portion of the elongated tubular sheath 302 around the stem 204 and the handle 202 ensures the elongated tubular sheath 302 to be tightly secured around the handle 202. The securing member 308 engages with the engagement member 208 upon accommodating the cleaning brush 200 in the elongated tubular sheath 302 and the cleaning pad 304. Engaging the securing member 308 with the engagement member 208 of the handle 202 holds the cleaning pad 304 between the exterior surface 206*a* of the cleaning head 206 and the target surface 102 to be cleaned while in use. The engagement member 208 is exemplary depicted to be 'a stud of the snap button'. Alternatively, the securing member 308 may include, but is not limited to, a hook, an adhesive tape, Velcro™ or any other suitable means as per the design feasibility and requirement. Similarly, the engagement member 208 may be selected suitably based on the securing member 308.

Figure 4B:
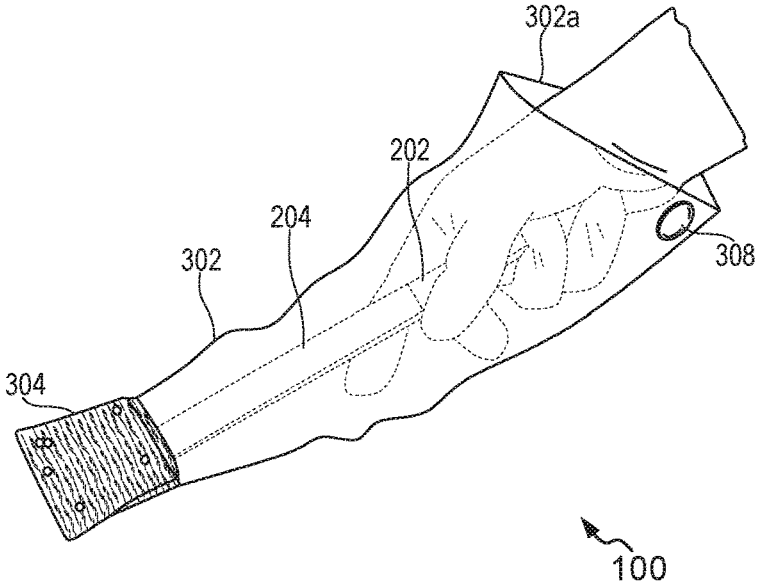

Further, the elongated tubular sheath 302 is configured with the larger area of cross-section at the open end 302*a* as described above. The larger area of cross-section at the open end 302*a* may allow the user to feasibly hold the handle 202 of the cleaning brush 200 when the cleaning brush 200 is accommodated in the elongated tubular sheath 302 and the cleaning pad 304 (e.g., as shown in FIG. 4B). In this scenario, the securing member 308 may not be secured with the engagement member 208, as the open end 302*a* is configured to provide access to the user for holding the handle 202. In this implementation, the elongated tubular sheath 302 prevents the user's hand from contacting the target surface 102 and protects from splashing of water, while cleaning the target surface 102.

The cleaning pad 304 is configured to substantially conform to the contour of the target surface 102 (i.e. toilet bowl surface), while cleaning the target surface 102. During the cleaning task, the cleaning pad 304 is interposed between the exterior surface 206*a* of the cleaning head 206 and the target surface 102 (e.g., as shown in FIG. 1). More specifically, the cleaning head 206 and the closed end 302*b* of the elongated tubular sheath 302 form a snug fit, so that a friction between the cleaning head 206 and the interior surface 306 helps in holding the elongated tubular sheath 302 with the cleaning pad 304 in place while in use. In an embodiment, an outer surface 304*a* of the cleaning pad 304 may be configured to be abrasive (i.e., a scrubbing surface) to effectuate cleaning of the target surface 102. Further, an inner surface (see, 404 of FIG. 4A) of the cleaning pad 304 that is oriented towards the exterior surface 206*a* of the cleaning head 206 when the cleaning pad 304 is secured over the cleaning head 206 may be configured with a hydrophilic material (e.g., hydrophilic urethane).

Further, the cleaning pad 304 is impregnated with additives, such as cleaning or disinfecting agents (see, 310 of FIG. 3) for immediate use during the cleaning task. This mitigates the need for other cleaning supplies for cleaning the target surface 102. For the purpose of illustration, the cleaning agents 310 are depicted as droplets present in porous cavity on the outer surface 304*a* of the cleaning pad 304. The cleaning agents 310 are selected from the group of, but not limited to, soaps, surfactants, detergents, antimicrobials, polymers, and waxes. In an embodiment, the cleaning agents 310 may be impregnated in the cleaning pad 304 in a gel form. Alternatively, the cleaning agents 310 may be impregnated in the cleaning pad 304 in an encapsulated form or any other suitable form as per feasibility and requirements. The cleaning agents 310 impregnated in the cleaning pad 304 may include materials (e.g., polymeric materials) that prevent premature hydration and slow down the effervescence. The cleaning agents 310 may be controllably released or emitted on the target surface 102 when the cleaning pad 304 is hydrated during the cleaning or wiping task. The cleaning agents 310 effervesce upon hydrating the cleaning pad 304 while being engaged in cleaning the target surface 102. Thus, the cleaning agents 310 impregnated in the cleaning pad 304 are used for effectuating cleaning of the target surface 102.

Figure 5A:
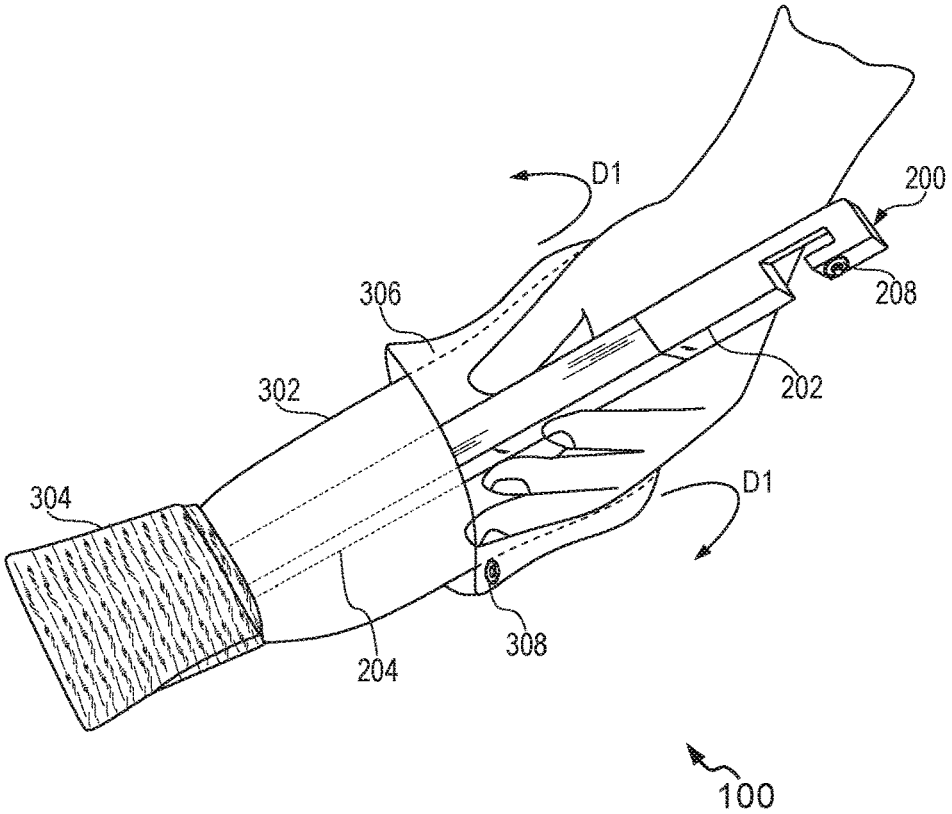
FIGS. 5A and 5B illustrate a step wise process to unsecure the elongated tubular sheath and detach the cleaning pad from the cleaning brush for disposal, in accordance with an example embodiment of the present disclosure.
Figure 5B:
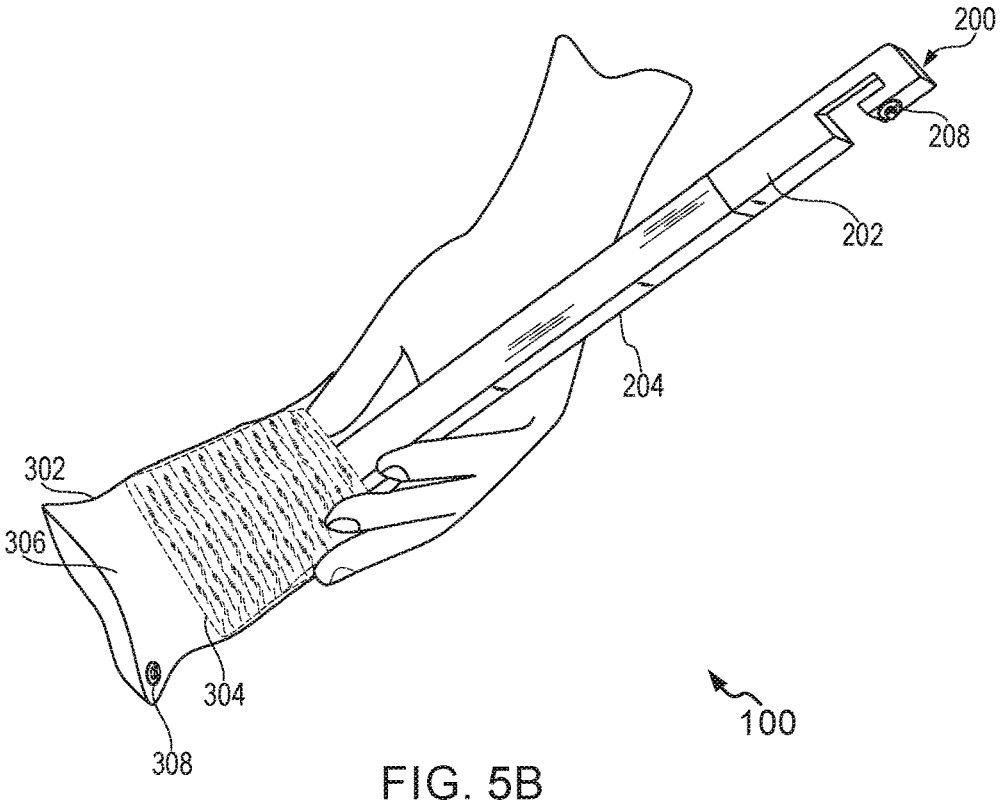

Referring now to FIG. 5A, the elongated tubular sheath 302 is unsecured from the handle 202 upon the cleaning or wiping task and pulled towards the closed end 302*b* of the elongated tubular sheath 302 such that the elongated tubular sheath 302 is turned inside-out. The pulling motion provided to the elongated tubular sheath 302 is depicted with a directional arrow 'D1'. In this scenario, a portion of the interior surface 306 of the elongated tubular sheath 302 is oriented away from the handle 202 and the stem 204 of the cleaning brush 200. Further, the elongated tubular sheath 302 configured to be turned inside-out enables the user to enclose the soiled cleaning pad 304 (e.g., as shown in FIG. 5B) that has contacted the waste particles (e.g., the liquid waste and the feces particles present on the toilet bowl surface) present in the target surface 102. The soiled cleaning pad 304 enclosed within the elongated tubular sheath 302 is detached or unsecured from the cleaning head 206 of the cleaning brush 200 by the user for disposal. Thus, the soiled cleaning pad 304 does not contact the user's hand or the components of the cleaning brush 200 when the elongated tubular sheath 302 and the cleaning pad 304 are disengaged from the cleaning brush 200. Therefore, the cleaning brush 200 is maintained in a dry and sanitary condition while cleaning the target surface 102, thereby enabling the cleaning brush 200 to be stored with clean household items for further use.

Various embodiments of the disclosure, as discussed above, may be practiced with steps and/or operations in a different order, and/or with hardware elements in configurations, which are different than those which, are disclosed. Therefore, although the disclosure has been described based upon these exemplary embodiments, it is noted that certain modifications, variations, and alternative constructions may be apparent and well within the spirit and scope of the disclosure.

Although various exemplary embodiments of the disclosure are described herein in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A cleaning apparatus for cleaning a target surface, the cleaning apparatus comprising:

a cleaning brush comprising:

a stem comprising a first end and a second end, a handle coupled to the first end of the stem and extending longitudinally from the stem, the handle adapted to be held by a user, and a cleaning head coupled to the second end of the stem, the cleaning head being greater in width and/or depth than the stem;

an elongated tubular sheath comprising an open end and a closed end, the open end configured with a greater cross-sectional area than the closed end, and the open end configured to allow receipt of the cleaning brush within the elongated tubular sheath; and a cleaning pad comprising an inner space, the cleaning pad secured to the closed end, wherein upon receipt of the cleaning brush within the elongated tubular sheath from a side of the cleaning head, the cleaning head is accommodated in the inner space by pushing the closed end within the cleaning pad, wherein the cross-sectional area of the open end is configured to allow the user to hold the handle of the cleaning brush when the cleaning brush is accommodated in the elongated tubular sheath and the cleaning pad, and wherein the elongated tubular sheath is configured to enclose the hand of the user while cleaning the target surface.

2. The cleaning apparatus as claimed in claim 1, wherein the cleaning brush inserted within the elongated tubular sheath causes an interior surface of the elongated tubular sheath to contact an exterior surface of the cleaning head, while accommodating the cleaning head in the inner space of the cleaning pad.

3. The cleaning apparatus as claimed in claim 1, wherein the elongated tubular sheath further comprises a securing member configured proximate to the open end of the elongated tubular sheath, wherein the securing member is removably engaged with an engagement member of the handle upon removably securing the elongated tubular sheath and the cleaning pad to the cleaning brush.

4. The cleaning apparatus as claimed in claim 1, wherein upon cleaning the target surface, the elongated tubular sheath is configured to be unsecured and turned inside-out for enclosing the soiled cleaning pad.

5. The cleaning apparatus as claimed in claim 4, wherein the soiled cleaning pad enclosed within the elongated tubular sheath is detached from the cleaning head of the cleaning brush for disposal.

6. The cleaning apparatus as claimed in claim 1, wherein the cleaning head secured to the second end of the stem is configured to be rotatably adjustable relative to the stem and the handle of the cleaning brush.

7. The cleaning apparatus as claimed in claim 1, wherein the cleaning head of the cleaning brush and the elongated tubular sheath are configured with an elastic material.

8. The cleaning apparatus as claimed in claim 1, wherein the cleaning pad is impregnated with cleaning agents to effectuate cleaning of the target surface, wherein the cleaning agents effervesce when the cleaning pad is hydrated.

9. The cleaning apparatus as claimed in claim 1, wherein the target surface is a toilet bowl.

10. A cleaning apparatus for cleaning a target surface, the cleaning apparatus comprising:

a cleaning brush comprising:

a stem comprising a first end and a second end, a handle coupled to the first end of the stem and extending longitudinally from the stem, the handle adapted to be held by a user, a cleaning head coupled to the second end of the stem, the cleaning head being greater in width and/or depth than the stem;

an elongated tubular sheath comprising an open end and a closed end, the open end configured with a greater cross-sectional area than the closed end, and the open end configured to allow receipt of the cleaning brush within the elongated tubular sheath; and a cleaning pad comprising an inner space, the cleaning pad secured to the closed end, wherein upon receipt of the cleaning brush within the elongated tubular sheath from a side of the cleaning head, the cleaning head is accommodated in the inner space by pushing the closed end within the cleaning pad, wherein the cleaning brush inserted within the elongated tubular sheath causes an interior surface of the elongated tubular sheath to contact an exterior surface of the cleaning head, while accommodating the cleaning head in the inner space of the cleaning pad, wherein the cross-sectional area of the open end is configured to allow the user to hold the handle of the cleaning brush when the cleaning brush is accommodated in the elongated tubular sheath and the cleaning pad, and wherein the elongated tubular sheath is configured to enclose the hand of the user while cleaning the target surface.

11. The cleaning apparatus as claimed in claim 10, wherein the elongated tubular sheath further comprises a securing member configured proximate to the open end of the elongated tubular sheath, wherein the securing member is removably engaged with an engagement member of the handle upon removably securing the elongated tubular sheath and the cleaning pad to the cleaning brush.

12. The cleaning apparatus as claimed in claim 10, wherein upon cleaning the target surface, the elongated tubular sheath is configured to be unsecured and turned inside-out for enclosing the soiled cleaning pad.

13. The cleaning apparatus as claimed in claim 12, wherein the soiled cleaning pad enclosed within the elongated tubular sheath is detached from the cleaning head of the cleaning brush for disposal.

14. The cleaning apparatus as claimed in claim 10, wherein the cleaning head secured to the second end of the stem is configured to be rotatably adjustable relative to the stem and the handle of the cleaning brush.

15. The cleaning apparatus as claimed in claim 10, wherein the cleaning head of the cleaning brush and the elongated tubular sheath are configured with an elastic material.

16. The cleaning apparatus as claimed in claim 10, wherein the cleaning pad is impregnated with cleaning agents to effectuate cleaning of the target surface, wherein the cleaning agents effervesce when the cleaning pad is hydrated.

17. The cleaning apparatus as claimed in claim 10, wherein the target surface is a toilet bowl.

* * * * *